United States Patent [19]

Salvarani

[11] Patent Number: 4,752,106

[45] Date of Patent: Jun. 21, 1988

[54] SLIDING DOOR CUPBOARD STRUCTURE

[75] Inventor: Antonio Salvarani, Viale Magenta 1, Parma, Italy

[73] Assignee: Antonio Salvarani, Parma, Italy

[21] Appl. No.: 884,840

[22] Filed: Jul. 11, 1986

[30] Foreign Application Priority Data

Jul. 24, 1985 [IT] Italy ..... 21690 A/85

[51] Int. Cl.[4] ..... E05D 15/08

[52] U.S. Cl. ..... 312/295; 312/138 R; 49/130; 49/207; 49/404

[58] Field of Search ..... 49/404, 130, 207; 312/138 R, 29, 301

[56] References Cited

U.S. PATENT DOCUMENTS

| | | | |
|---|---|---|---|
| 3,017,233 | 1/1962 | Gates | 312/138 R X |
| 3,280,507 | 10/1966 | Kollsman | 49/130 |
| 3,334,442 | 8/1967 | Boettcher | 49/404 X |
| 3,828,693 | 4/1973 | Kampmann et al. | 105/378 |

*Primary Examiner*—Joseph Falk

*Attorney, Agent, or Firm*—Guido Modiano; Albert Josif

[57] ABSTRACT

The sliding door cupboard structure comprises a body closable frontally by at least two mutually sliding doors, and a guide plate supported on the body and spanning substantially the full width of the body. With the guide plate there operatively interact support elements for each of the sliding doors, to which there are connected link elements operative with the guide plate which are adapted to permit free displacement of the support elements with respect to the guide plate at all places on the plane defined by the guide plate itself.

11 Claims, 5 Drawing Sheets

13
11
10
13
40
27
30
30
25
26
41
42
41
45
45
27a
20
61
21
60
47
50
52
50
47
51
52

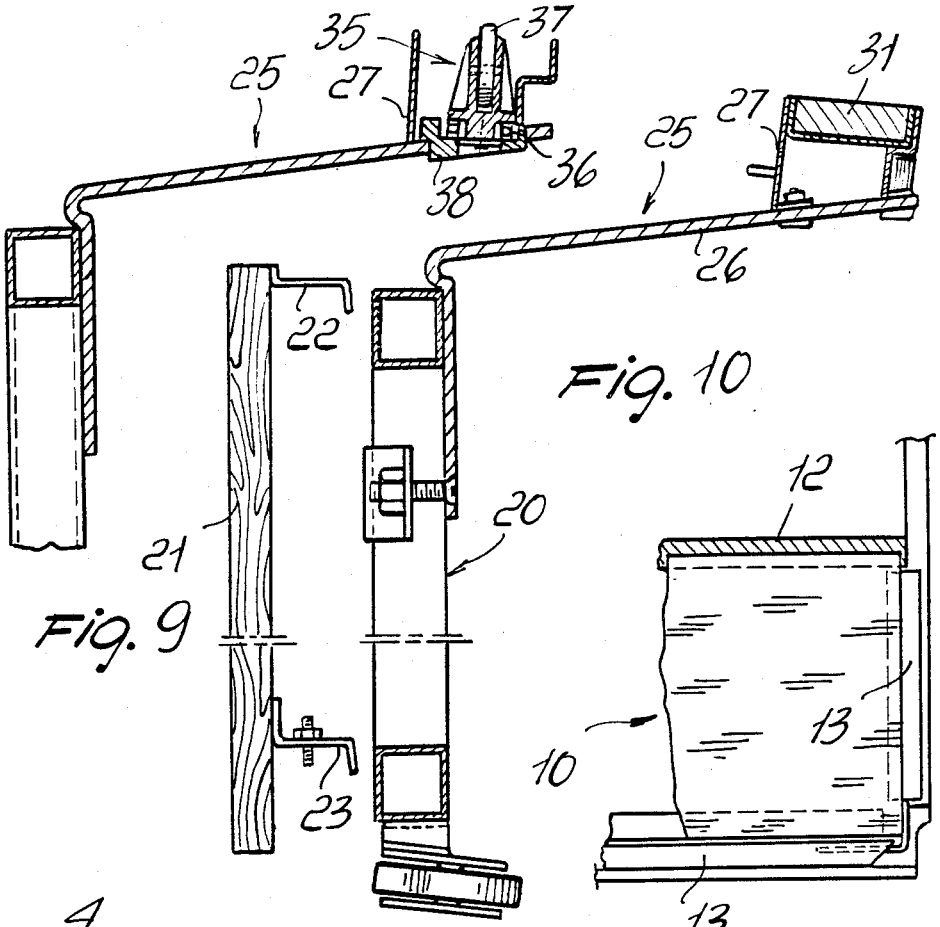
Fig. 10
Fig. 9
Fig. 8
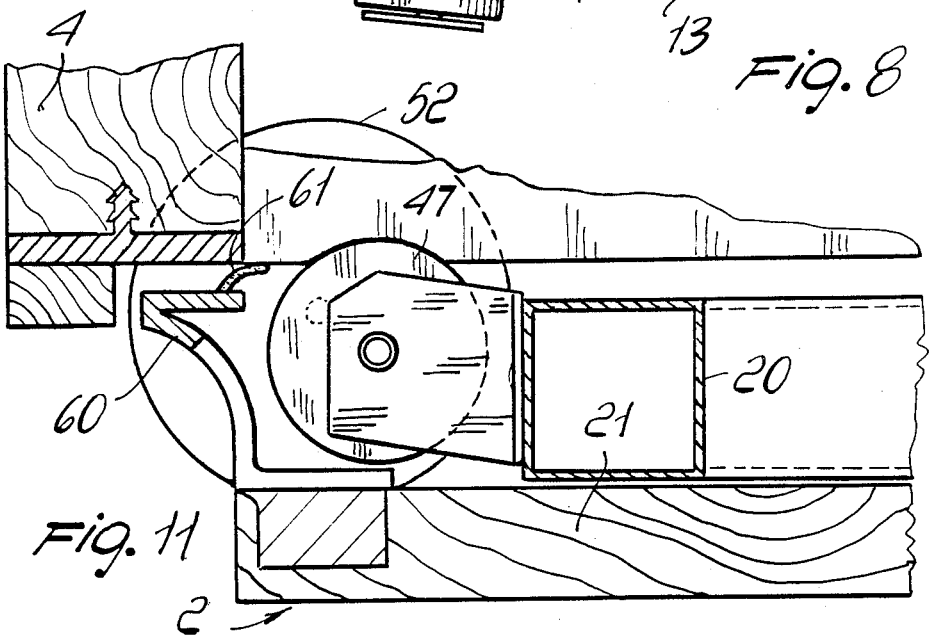
Fig. 11

SLIDING DOOR CUPBOARD STRUCTURE

BACKGROUND OF THE INVENTION

This invention relates to a sliding door cupboard structure.

As is known already available in the furniture trade are sliding door items of furniture wherein the doors, in their shut condition, lie coplanar to each other.

With such items of furniture it is necessary, when a door is to be opened, that the door moves away from its abutment plane, so that it can overlap its adjoining door and permit opening.

The state of the art solutions currently provide slideways for the doors wherin there are connected swivel arms permitting a door to be moved toward and away from the item of furniture for opening and closing.

The solutions currently adopted are generally quite complicated from a structural viewpoint, since they require a plurality of arms and swivel joints to enable the combination of above outlined movements.

Another drawback of the state of the art solutions is that, additionally to being difficult to assemble, the doors can only undergo movements which are strictly dictated by the type of guides employed, and in general, each door must be always returned to a preset position.

Another drawback of the state of the art solutions is that all the mechanisms used are liable to jam on account of their complex construction and of the large number of the components employed.

SUMMARY OF THE INVENTION

It is therefore the aim of this invention to overcome such drawbacks by providing a sliding door cupboard structure which affords free movement of the doors, these being relieved of any particular link and able to move in a plane defined by a guide plate provided on the cupboard itself.

Within the above aim it is a particular object of the invention to provide flush closing sliding doors which are not connected to the cupboard by swivel elements or articulated mechanical arms, thus considerably simplifying all the constructional aspects.

Another object of this invention is to provide a sliding door cupboard structure wherein the doors can be moved with great simplicity because of the door weight being counteracted, at least in part, by the elements provided for supporting and guiding the doors themselves.

A further object of this invention is to provide a sliding door cupboard structure wherein the doors are freely movable, even simultaneously, with the possibility of repositioning the door to shut any of the spaces pre-arranged to accommodate the doors.

A not least object of this invention is to provide a sliding door cupboard structure which is readily obtainable from commerically available elements and materials, and which is competitive from a purely economical standpoint.

The above aim and these and other objects to become apparent hereinafter are achieved by a sliding door cupboard structure, according to the invention, comprising a sliding cupboard structure comprising a hollow body having at least one top portion, a least two lateral sides at least, one bottom portion, and at least one opening defining a width dimension, and said sliding door cupboard structure further comprising, a plurality of sliding door, at least one guide plate, a plurality of support elements defining a movement plane, and a plurality of link elements, said top portion upwardly delimiting said opening, said bottom portion downwardly delimiting said opening and said at least two lateral sides laterally delimiting said opening, said plurality of sliding doors being adapted for openably closing at least a portion of said opening, said guide plate being rigidly associated with said upper portion of said hollow body and spanning said width dimension defined by said opening, each sliding door in said plurality of sliding doors having a top edge, at least two link elements in said plurality of link elements being rigidly associated with said top edge of said each sliding door in said plurality of sliding doors, each link element in said plurality of link elements being rigidly associated with at least one support element in said plurality of support elements and adapted for co-operation with said guide plate and for supporting at least one of said sliding door, said support elements each being further adapted to move freely in any direction in said movement plane, said movement plane extending substantially parallel to said guide plate.

BRIEF DESCRIPTION OF THE DRAWINGS

Further features and advantages will become apparent from the description of a preferred, but not exclusive, embodiment of a sliding door cupboard structure, shown by way of illustration and not of limitation in the accompanying drawings, where:

FIG. 8 shows the detail of the guide plate;

FIG. 9 shows in section the conformation of the door top bracket;

FIG. 10 is a sectional exploded view of the frame of the door with its related covering panel as equipped with latch means;

FIG. 11 illustrates, to an enlarged scale, the detail of a lower wheel for the door sliding movement;

DESCRIPTION OF A PREFERRED EMBODIMENT

Figure 1:
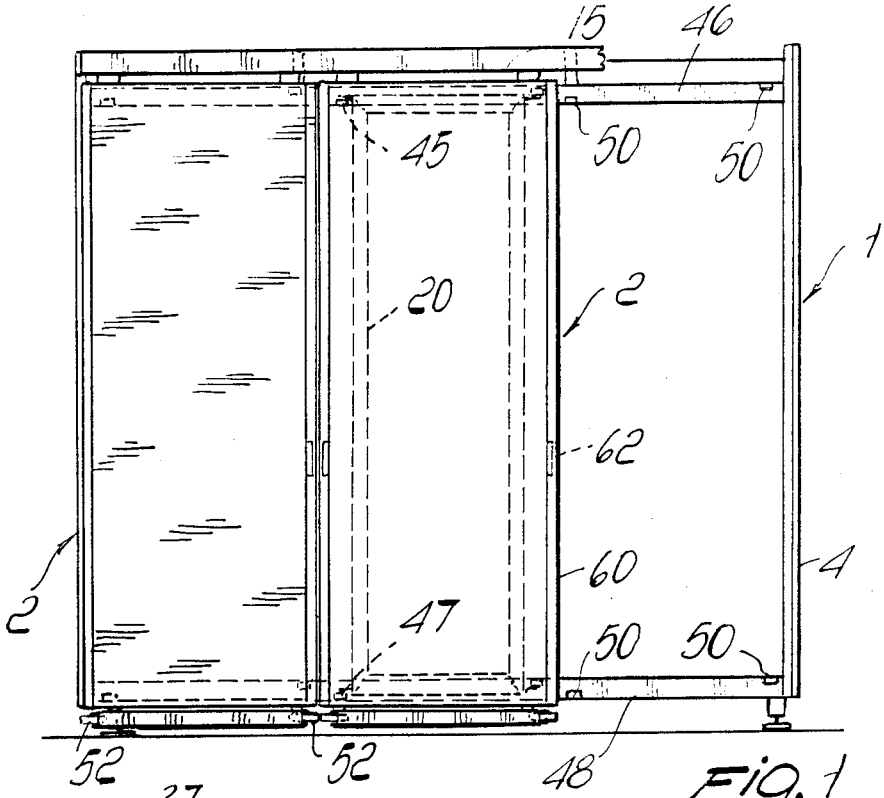
FIG. 1 shows diagrammatically a front view of a cupboard with three slding doros.

With reference to the cited drawings, the sliding door cupboard structure, according to the invention, comprises a body 1 which has the customary parallelepipedal conformation with the forward portion or opening closeable by means of sliding doors, generally designated with the reference numeral 2, which in the accompanying drawing are three in number, but of course, can be any number according to the width of the cupboard.

The body 1 has a top, or top portion, 3 which joins the lateral sides 4 together with a bottom or base, 5. The body is then completed by a back 6.

Above the top 3, at the front portion of the cupboard, a guide plate 10, formed from a ferromagnetic material is mounted, sloping toward the rear portion of the cupboard.

The plate 10 is supported on central brackets 11 which, at one end thereof are attached to the top 3 by screws or the like.

At a middle portion there are provided supports 12 connected to the top 3.

Furthermore, peripherally the plate is supported by sectional members generally designated 13 which enable its connection respectively to an upper front 15 of the cupboard and the lateral sides 4.

The cited doors 2 comprise a door frame 20, advantageously composed of a metal tubular frame on which an outer panel 21 is superimposable which can take any pattern considered appropriate.

The panel 21 is provided with upper hooks 22 and lower hooks 23, provided with one or more adjustment set screws, for precise positioning with respect to the frame 20.

To the upper portion of the frame 20 there are connected door supporting elements, generally designated with the reference numeral 25, which comprise a bracket 26 affixed to the frame and overhanging toward the inner portion of the cupboard to be receivable, as explained hereinafter, in the area bounded between the support 12 and the upper front 15 of the cupboard itself.

At its free inner end the bracket 26 is connected to upper section bar 27 having in cross-section a substantially upwardly open U-like conformation, to the longitudinal ends whereof there are connected upper overlap wheels 30 which have a substantially vertical axis.

The sectional member 27 then supports, at its central portion, magnetic bars or blocks indicated at 31 which exert an action of magnetic attraction toward the guide plate 10 formed from a ferromagnetic material.

The magnetic blocks 31 are sized to exert a magnetic attraction force, exceeding the door own weight, so as to have, as the useful overall effect, attraction of the door toward the upper portion.

Close to the ends of the upper overlap wheels 30 there are provided spacer wheels, generally designated with the reference numeral 35, which are supported on upper section bar.

Figure 13:
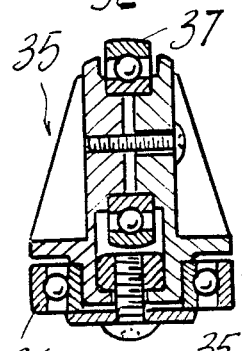
FIG. 13 is a detail sectional side view of the spacer wheels.
Figure 13:
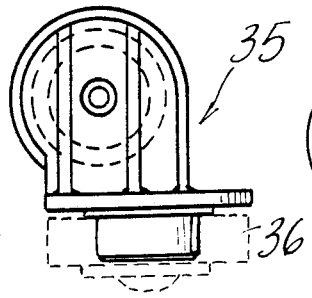
Figure 12:
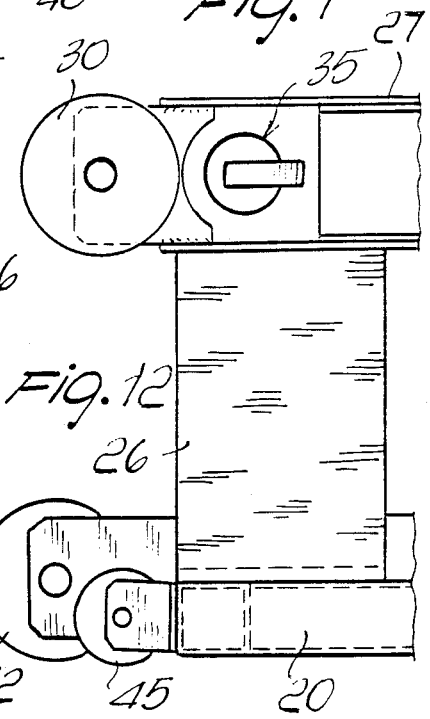
FIG. 12 shows the edge of a door with overlap and sliding wheels.
Figure 14:
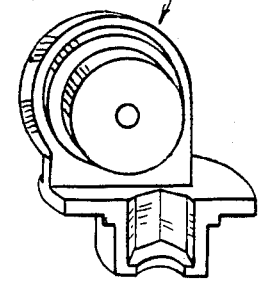
FIG. 14 depicts in exploded perspective view of the detail of the two parts forming the support element for the spacer wheel bearings.
Figure 14:
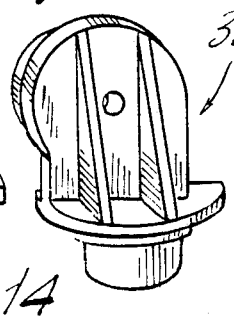
Figures 2, 3:
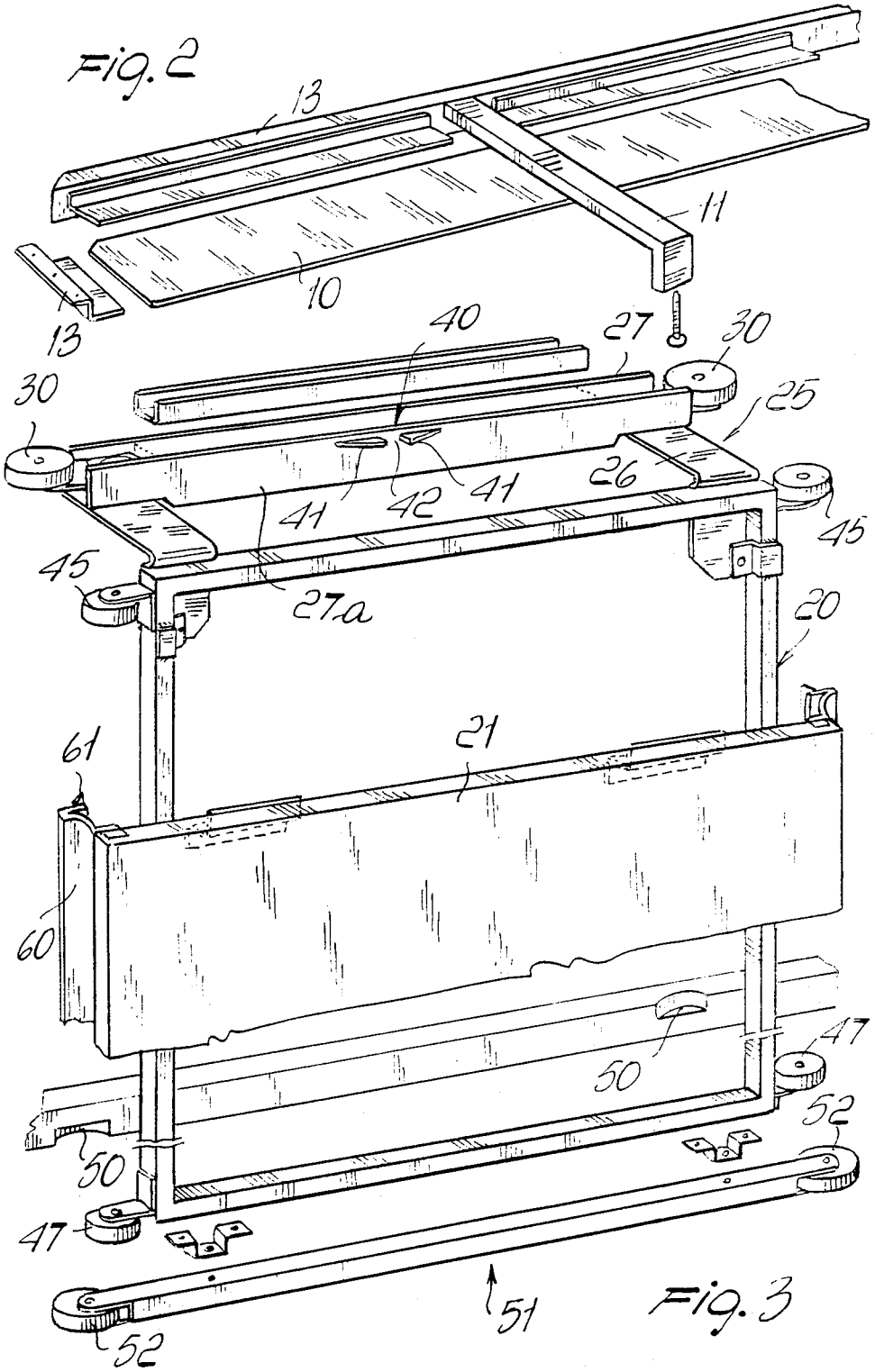
FIG. 2 is an exploded perspective view of the guide plate.
FIG. 3 is a part-exploded perspective view showing diagrammatically the support elements for each door.
Figure 4:
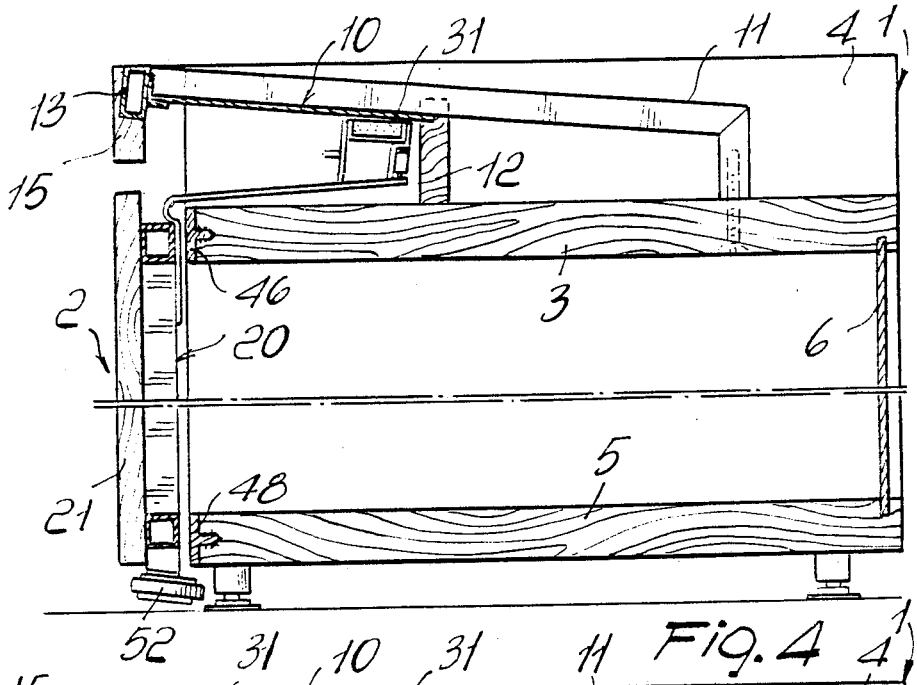
FIG. 4 shows a longitudinal section through a door as attached to a cupboard.
Figure 5:
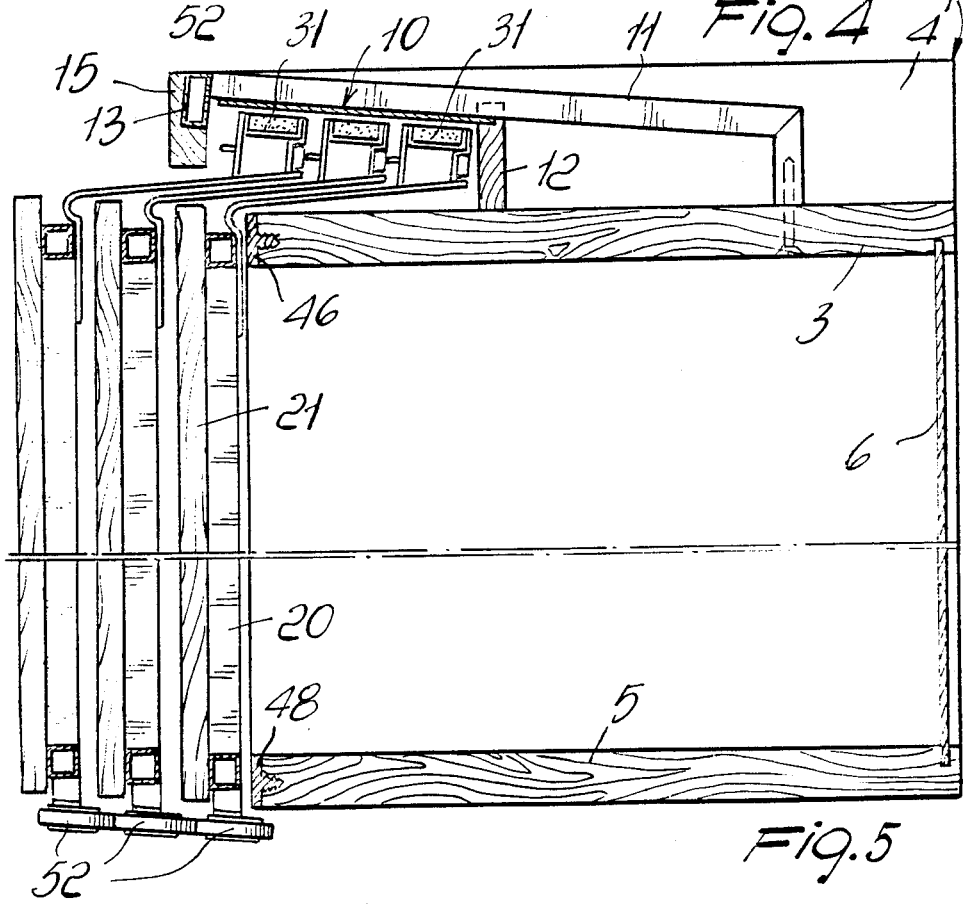
FIG. 5 brings out diagrammatically the possible overlapped positioning of the three sliding doors.

According to a preferred, but not limitative, embodiment the spacer wheels 35, as shown in FIGS. 13 and 14, comprise of a first bearing 36 rotatable about a first axis and a second bearing 37 rotatable about a perpendicular axis.

The first bearing 36 is housed in an insert 38 supported on the upper section bar 27, whilst the second bearing 37 acts by contact against the plate 10, so as to prevent adhesion between the magnetic blocks and the plate itself, which would prevent free sliding of the doors with respect to the plate, and to keep an almost constant distance so as to have a constant magnetic attraction adjustable at will.

On the front face of the upper section bar 27 there is provided a centering seat 40, which is comprised of a pair of wedge-like projections 41 defining a recess 42 therebetween. In the recess 42 is removably receivable, for centering, a projection 43 formed of a small roller correspondingly positioned on the opposed face of the upper section bar 27 such that the wedgelike projections extend further than the diametrical plane of the roller at the moment of engagement. At the upper portion of the frame 20 there are provided upper sliding wheels 45 which, with the door arranged to close the cupboard, engage with an upper edge 46 defined on the front of the top 3.

The wheels 45, which are provided at the upper side ends of the frame 20 show to be offset from each other, i.e. not at the same level, for reasons to be explained hereinafter.

Downwardly the frame 20 has lower sliding wheels 47, mutually offset in height,

The wheels 47 run on a lower slide edge 48 defined by the base 5 of the cupboard.

On the lower slide edge, as well as on the upper slide edge there are provided receptacles 50 wherein the wheels 45 and 47 introduce partway to effect accurate positioning of the door in the shut condition.

The wheels and related positioning seats are arranged offset so that, when the doors are caused to slide against the cupboard, no particularly strong opposition is met which could hinder the sliding movement of the doors on the cupboard.

Below the frame 20, in a lower area than the area affected by the covering panel of the door 21 there is provided a lower molding or lower section bar, 51 which, at its ends carries lower overlap wheels 52, which have a slidingly inclined axis with respect to the vertical axis of the cupboard and arranged substantially perpendicularly with respect to a plane having the same inclination as the guide plate 10.

The cupboard is then completed by longitudinal moldings 60 attached to the lower face of the panels 21 at their longitudinal edges and being provided with sealing lips, indicated at 61. Furthermore, on the moldings 60 there are provided cutouts or the like elements, indicated at 62 which define in practice a handle or gripping means for moving the doors.

In practical use there occurs that the doors in the shut position show to be arranged side-by-side and coplanar to each other.

In this condition the individual doors supported on account of the presence of the magnetic blocks 31 are held from above and are slidable with respect to the guide plate 10 by engagement of the spacer wheels, which behave in practice as pivoting elements, against the plate 10 itself.

Figure 6:
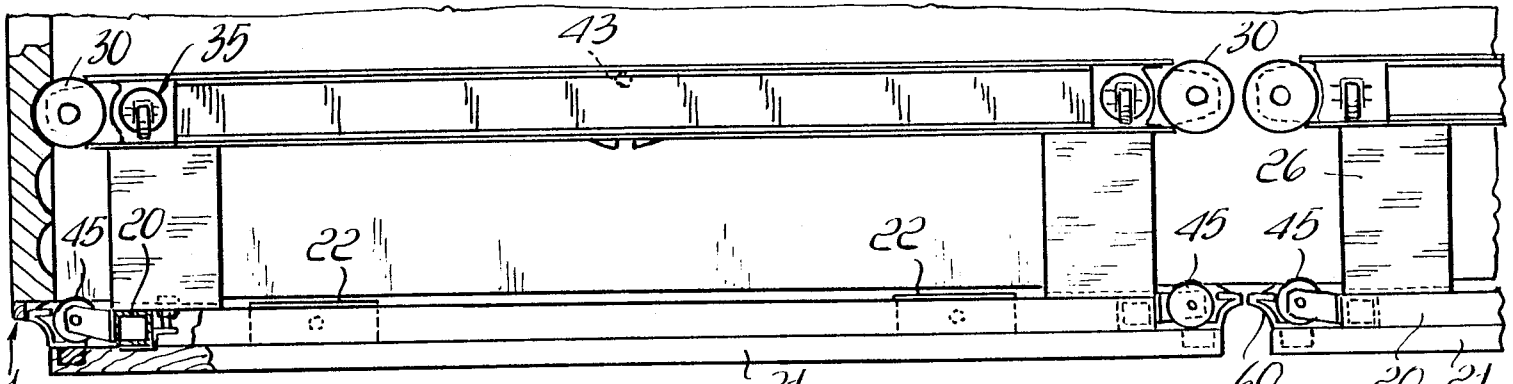
FIG. 6 shows, partly in section, the cupboard as viewed from above with the doors arranged coplanarly to one another brought out.
Figure 7:
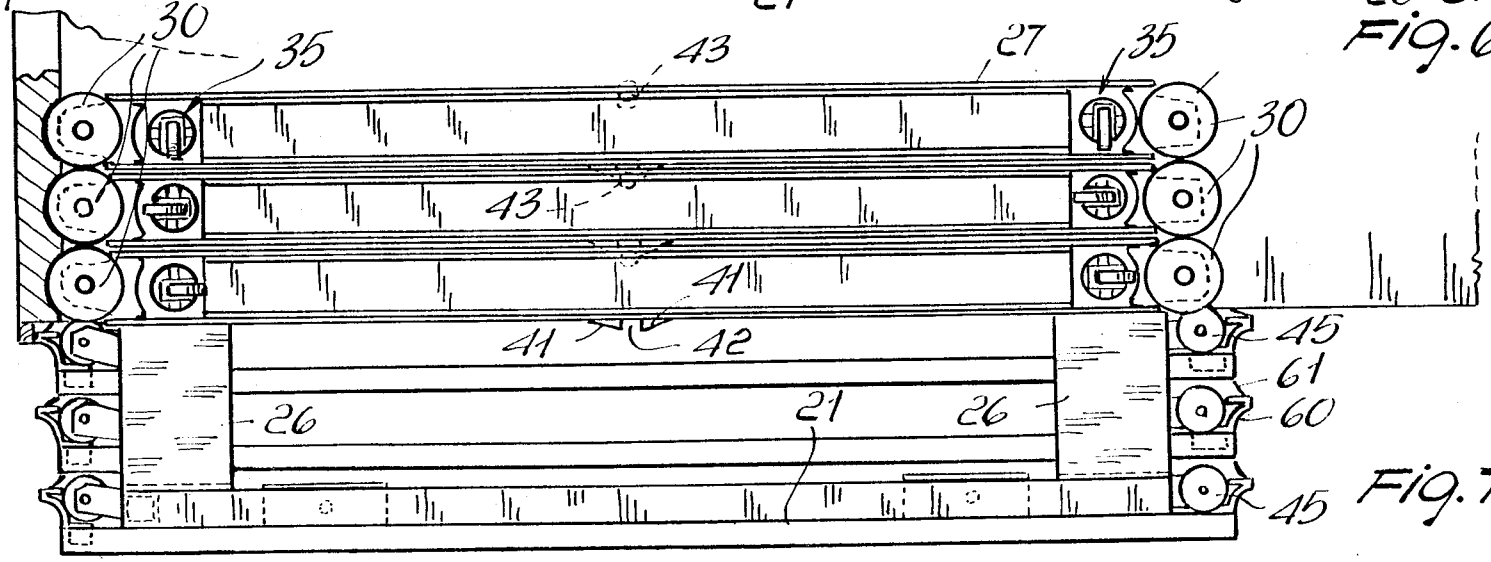
FIG. 7 is a top plan view of the cupboard with all the doors arranged to overlap one another.

Furthermore, with the doors in the closed position there occurs that the upper 45 and lower 47 sliding wheels are in contact respectively with the upper slide edge and the lower slide edge and are housed in their respective positioning seats as seen in FIGS. 6 and 11.

The overlap wheels 52 and 30 of the various doors show to be set close together.

When opening a door it occurs that, by the mutual engagement of the upper overlap wheels and lower overlap wheels, the door performs preliminarily a displacement toward the cupboard exterior and the mutual contact between the doors takes place solely by the rest of the lower and upper overlap wheels with the upper track and the lower track, while the upper and lower sliding wheels, which have a smaller diameter than the overlap wheels, do not touch the lower door because they would cause scoring on the exposed portion of the door. The opening is achieved by simply pulling a door by the handle, i.e. the cutout 62, toward the exterior and then making it slide on one side overlapping another door or doors.

The mutually overlapping doors are centered together by the presence of the centering element formed of the roller 43 which inserts itself into the centering seat for the door placed downwardly, thereby the overlapping doors are perfectly centered to one another and can, if necessary, be caused to slide together.

To effect the closure it is sufficient to disengage from one another the overlapping doors returning the overlapped door against the cupboard being helped in this by the fact that the guide plate which supports them is inclined toward the rear portion of the cupboard, thereby there occurs a natural movement of approach of the door against the cupboard for its re-positioning in its respective seat. Furthermore, the magnetic blocks 31 being mounted with a rearward offset with respect to the door panels and frame, by means of the brackets 26, the wheels 47 tend to abut against the cupboard edge by gravity.

To this aim, the spacer wheels which engage with the guide plate 10 are of the pivoting type thereby they can easily follow any displacement of the door.

Of particular importance is the fact that the doors have no guide which binds their movement unilaterally, but each door shows to be freely movable in the area defined by the guide plate, so that there exists no rigid link in the door displacement.

The door is in practice held soley by magnetic action in its upper portion and rests against the cupboard or against the guide plates of the doors to facilitate the sliding movements.

As already mentioned above the magnetic blocks are sized to exert a magnetic attraction action exceeding the door weight, so as to have a firm adhesion holding the door with respect to the cupboard, and so as to "relieve" the door of its own weight.

Thus, the user moves a weight which, in a sense, is considerably reduced with respect to the door's own weight, thereby the sliding movement of the door itself is greatly facilitated.

It should be also pointed out that the doors have no bound closure position, but each door can be positioned at any place on the cupboard all the doors being alike.

Furthermore, the presence of the bracket 26 which overhangs toward the inner portion affords the possibility of obtaining overlap of all the doors without mutual interference, because rest between the overlapping doors is solely provided by the overlap wheels which act in practice on portions of the door which are concealed from view, so that no damage is caused to the exposed surface of the door which may be patterned and decorated in any style.

Furthermore, the inclined setting of the guide plate brings always about an all the doors a component which tends to bias the doors either toward the cupboard or toward the lower door thus providing a practically automatic form of adjustment of the door positioning.

It may thus be appreciated from the foregoing description that the invention achieves the objects set forth and in particular the fact should be pointed out that a cupboard with sliding doors has been provided, wherein the traditional conception of a door support is subverted and completely modified which is based generally on the presence of fixed or moving guides to which the doors are linked mechanically; with the cupboard of this invention there occurs instead that the connection of the doors to the cupboard is effected by magnetic action, with the possibility, therefore, of having "free" movement of the doors with respect to the guide and a sliding movement which is at all times smooth and easily effected.

Furthermore, it should be pointed out that in the event that forces exceeding the door weight and larger than the magnetic action are applied erroneously to the door, the door would tend to disengage itself and move away from the upper guide plate, but it would not come out owing to the presence of the upper front which would hold it.

Furthermore, by providing wheels independent of one another for the movements of mutual door overlap and for sliding the doors with respect to the cupboard, the exposed outer surface of the door is in no way affected by the displacements produced and consequently subjected to no damage.

Another important object of the invention is then that the doors have a metal frame, to which all the mechanisms described above are connected, and that it remains unchanged whatever the door's outer appearance may be, the outer appearance of the door being determined by a panel which is applied to the door's metal frame.

Furthermore, the presence of the centering seat affords the possibility of effecting a mutual coupling, easily removable where required, between the overlapping doors, thereby the overlapping doors can be easily made to slide together so as to obtain opening of the cupboard in the manners found more appropriate.

The invention herein is susceptible to many modifications and variations within the scope of the inventive concept.

Furthermore, all the details may be replaced with other technically equivalent elements.

In practice, any dimensions, contingent shapes and materials may be used, so long as compatible with the specific use, according to necessity.

I claim:

1. A sliding door cupboard structure comprising a receptacle defining composite body of generally parallelepipedal conformation with an open side and with top wall means, bottom wall means and lateral wall means delimiting said open side, a plurality of sliding doors for openably closing in mutually coplanar relationship said opening, a guide plate of ferromagnetic material mounted on said top wall means, each of said sliding doors having support elements in the from of brackets mounted at a top portion thereof and link elements in the form of magnetic blocks mounted on said brackets and facing said guide plate for mutual magnetic attraction therewith thereby to exert a supporting action for said doors, spacer wheels mounted on said support elements and adapted for sliding on said guide plate to prevent direct contact between said magnetic blocks and said guide plate, said magnetic blocks being movable with respect to said guide plate, said guide plate having a depth sufficient to overlay at least two said sliding doors positioned in mutually overlapped relationship.

2. A structure, according to claim 1, wherein said spacer wheels comprise casters.

3. A structure, according to claim 1, wherein each of said sliding doors comprises at least one panel and at least one tubular metal frame having a frame top edge and a bottom, said at least one panel being removably connected to said at least one tubular metal frame, said brackets having a rearward extension and said structure further comprising at least one lower section bar and at least one upper section bar, said rearwardly extending brackets being mounted on said frame top edge, said upper section bar being connected to said rearwardly extending brackets, said lower section bar being connected to said bottom of said frame, said panels defining an exposed portion of said doors.

4. A structure, according to claim 3, further comprising upper sliding wheels, lower sliding wheels, an upper side edge, a lower slide edge, said upper slide edge and said lower slide edge being defined on said hollow body at said opening, said upper sliding wheels being mounted on said frame top edge, said lower sliding wheels being mounted on said bottom of said frame, said upper-sliding wheels and said lower sliding wheels being adapted for sliding respectively on said upper slide edge and lower slide edge.

5. A structure, according to claim 3, further comprising upper sliding wheels, lower sliding wheels, an upper slide edge, a lower slide edge, said upper slide edge and said lower slide edge being defined on said hollow body at said opening, said upper sliding wheels being mounted on said frame top edge, said lower sliding wheels being mounted on said bottom of said frame, said upper-sliding wheels and said lower sliding wheels being adapted for sliding respectively on said upper slide edge and said lower slide edge, said structure further comprising at least two upper positioning seats, and at least two lower positioning seats, said upper positioning seats being provided on said upper slide edge, said lower positioning seats being provided on said lower slide edge, said upper sliding wheels being engageable with said upper positioning seats, said lower sliding wheels being engageable with said lower positioning seats, said upper positioning seats being arranged at different heights on said upper slide edge, said upper sliding wheels corresponding in number to said upper positioning seats and correspondingly arranged at different heights, said lower positioning seats being arranged at different heights on said lower slide edge, said lower sliding wheels corresponding in number to said lower positioning seats and correspondingly arranged at different heights.

6. A structure, according to claim 3, wherein at least one sliding door is an overlapping door, and wherein said structure further comprises upper overlap wheels and lower overlap wheels, said upper overlap wheels being mounted on said upper section bars, said lower overlap wheels being mounted on said lower section bars, said lower section bars each defining, at least one lower guide for said lower overlap wheels of said overlapping door, said upper section bars defining at least one upper guide for said upper overlap wheels of said overlapping door.

7. A structure, according to claim 3, wherein at least one sliding door is an overlapping door, and wherein said structure further comprises upper overlap wheels and lower overlap wheels, said upper overlap wheels being mounted on said upper section bars, said lower overlap wheels being mounted on said lower section bars, said lower section bars each defining, at least one lower guide for said lower overlap wheels of said overlapping door, said upper section bars defining at least one upper guide for said upper overlap wheels of said overlapping door, said structure further comprising at least one centering seat and at least one centering element, said section bar having at least one side and at least one other side, said centering seat being provided at said at least one side of said upper section bar, said centering element being provided on said at least one other side of said section bar, said centering element being adapted for engagement with said centering seat of said overlapped door.

8. A structure, according to claim 3, wherein at least one sliding door is an overlapping door, and wherein said structure further comprises upper overlapp wheels and lower overlap wheels, said upper overlap wheels being mounted on said upper section bars, said lower overlap wheels being mounted on said lower section bars, said lower section bars each defining, at least one lower guide for said lower overlap wheels of said overlapping door, said upper section bars defining at least one upper guide for said upper overlap wheels of said overlapping door and wherein said lower overlap wheels have an axis of rotation, said axis of rotation extending substantially perpendicular to said guide plate.

9. A structure, according to claim 3, further comprising upper sliding wheels, lower sliding wheels, an upper slide edge a lower slide edge, said upper slide edge and said lower slide edge being defined on said hollow body at said opening, said upper sliding wheels being mounted on said frame top edge, said lower sliding wheels being mounted on said bottom of said frame, said upepr-sliding wheels and said lower sliding wheels being adapted for sliding respectively on said upper slide edge and said lower slide edge, wherein said panels each define an outer surface of said doors, and wherein each of said sliding wheels defines an external diameter, on said external diameter of each of said sliding wheels there being defined at least one point, said point being diametrically opposite to said outer surface, between said outer surface and said point there being defined a distance, said doors including at least one overlapping door having an outer surface and at least one overlapped door having an outer surface, between said outer surface of said overlapping door and the outer surface of said overlapped door there being defined a spacing distance, said distance being greater than said spacing distance.

10. A structure according to claim 1, wherein said guide plate is downwardly inclined in a rearward direction.

11. A structure, according to claim 3, wherein said panels are provided on their sides defining the lateral sides of said doors, with longitudinal moldings, each of said moldings being provided with a gasket, said gasket being adapted for sealing said hollow body when said doors are positioned for closing said opening, said moldings being further provided with a cutout, said cutout defining a gripping element adapted for permitting handling of said doors.

* * * * *